United States Patent [19]

Tarry

[11] Patent Number: 4,926,026

[45] Date of Patent: May 15, 1990

[54] ELECTRICAL DE-ICER DEVICE

[75] Inventor: Timothy A. Tarry, Hudson, Ohio

[73] Assignee: Maintenance Concepts, Inc., Hudson, Ohio

[21] Appl. No.: 302,791

[22] Filed: Jan. 26, 1989

[51] Int. Cl.[5] ..... H05B 3/02; F24H 7/06

[52] U.S. Cl. ..... 219/213; 219/341; 219/549

[58] Field of Search ..... 219/213, 528, 525, 530, 219/540, 549, 345, 341, 522, 532, 533, 534, 548, 550, 552, 553; 338/213; 15/215, 216; 165/47, 104.19

[56] References Cited

U.S. PATENT DOCUMENTS

| | | | |
|---|---|---|---|
| 1,966,465 | 7/1934 | Schuhmacher | 15/215 |
| 2,253,813 | 8/1941 | Russon | 15/215 |
| 2,486,791 | 11/1949 | Mann et al. | 219/345 |
| 2,497,998 | 2/1950 | Lee | 219/549 |
| 2,702,334 | 2/1955 | Kleist | 219/341 |
| 2,844,696 | 7/1958 | Custer, Jr. | 219/549 |
| 2,912,555 | 11/1959 | Jamison . | |
| 2,997,568 | 8/1961 | Leipold et al. . | |
| 3,047,701 | 7/1962 | Frungel . | |
| 3,193,664 | 7/1965 | Beery | 219/549 |
| 3,209,128 | 9/1965 | Chapman, Jr. | 219/528 |
| 3,244,858 | 4/1966 | Thorpe, Jr. | 219/345 |
| 3,281,578 | 10/1966 | Chapman, Jr. | 219/528 |
| 3,353,003 | 11/1967 | Somero | 219/341 |
| 3,683,152 | 8/1972 | Laing | 219/341 |
| 3,807,044 | 4/1974 | Ziemek | 219/548 |
| 3,812,320 | 5/1974 | Borgren | 219/213 |
| 3,976,855 | 8/1976 | Altmann et al. | 219/532 |

FOREIGN PATENT DOCUMENTS

| | | | |
|---|---|---|---|
| 2251132 | 10/1973 | Fed. Rep. of Germany | 219/549 |
| 2237981 | 2/1974 | Fed. Rep. of Germany | 219/532 |
| 2355976 | 5/1975 | Fed. Rep. of Germany | 219/532 |
| 879827 | 11/1981 | U.S.S.R. | 219/528 |
| 2195015 | 3/1988 | United Kingdom | 219/341 |

*Primary Examiner*—A. D. Pellinen
*Assistant Examiner*—Geoffrey S. Evans
*Attorney, Agent, or Firm*—D. Peter Hochberg; Mark Kusner; Louis J. Weisz

[57] ABSTRACT

An electrical de-icer device comprises a grid-like mat with a pattern of vertical perforations extending therethrough, and including a horizontal pathway of hollow metal tubing in which an electrical heating element is located. The mat also includes metal heat conducting members (14) in contact with the metal tubing so that heat from the wiring can be conducted uniformly throughout the mat.

20 Claims, 3 Drawing Sheets

ELECTRICAL DE-ICER DEVICE

TECHNICAL FIELD

This invention relates to a device for removing ice and snow. More particularly, this invention relates to a device for melting ice and snow from areas where their presence might otherwise constitute a hazard or inconvenience. Specifically, this invention relates to a mat-like grid of connected structural elements in association with heat conductors, the components of the mat being fastened together by hollow metal tubing containing high-resistance electrical wiring, the latter provinding the heat required to melt the ice and snow from the surfaces to be protected.

BACKGROUND OF THE INVENTION

Accidental falls are one of the primary causes of disabling injuries to individuals, especially those of advantaged age, and those suffering from physical infirmities. The exposure to falls is particularly acute in the winter season, when snow and ice adds to the problem. The hazard is aggravated, for example, by the presence of ice and snow on such surfaces as walkways, ramps, entranceways, helicopter pads and similar places, and while attempts are normally made to keep these locations clear of accumulations, it is not always possible or convenient to do so.

Furthermore, "passive" measures to prevent snow and ice accumulations such as, for example, the distribution of salt, sand and similar materials on the surfaces to be protected are not always effective, due to temperatures below that at which salt is effective because of additional accumulations of snow and ice, or for other reasons.

In the past, it has been proposed to employ certain "active" methods for eliminating snow and ice on such surfaces.

U.S. Pat. No. 2,912,555, for instance, shows a heating assembly comprising an insulating board laced with electrical heating wire.

U.S. Pat. No. 2,997,568 describes a heating element intended for embedding in concrete consisting of wire mesh to which electrical heating wire is attached.

U.S. Pat. No. 3,047,701 teaches a layered heating assembly, also designed for embedding in concrete.

U.S. Pat. No. 3,193,664 illustrates another electrical heating element intended for embedding in concrete slabs.

U.S. Pat. No. 3,209,128 details a still further heating mat intended for embedding in concrete.

U.S. Pat. No. 3,244,858 reveals a rigid panel having electrical wires embedded therein, used for a variety of heating requirements.

U.S. Pat. No. 3,812,320 is directed to a mat heated with electrical wires, which is provided with heat distributing interior chambers.

U.S. Pat. No. 3,967,855 involves formation of a thermoplastic sheet provided with multiple grooves into which electrical resistance elements are forced.

While some of the preceding devices address problems similar to those which the invention herein disclosed seeks to eliminate, many of the devices described are not portable; others comprise permanent installations which are difficult to maintain and repair, while still others are impractical insofar as the removal of ice and snow from large areas is concern.

SUMMARY OF THE INVENTION

In view of the preceding, therefore, it is a first aspect of this invention to provide an electrical de-icer device for melting snow and ice.

A second aspect of this invention is to provide a device for melting snow and ice that is portable, and that can be fabricated in a variety of sizes.

A further aspect of this invention is to furnish and electrical de-icer device that provides superior heat transfer characteristics, and therefore, one that exhibits superior energy efficiencies.

An additional aspect of this invention is to provide a device for removing ice and snow that eliminates the need for installing permanent de-icing equipment that is difficult to maintain.

Another aspect of this invention is to allow snow and ice to be melted from surfaces exposed thereto without the used of corrosive chemicals.

A still additional aspect of this invention is to provide an electrical heating device that can be interconnected with other like-devices to cover whatever surface area is involved.

Yet a further aspect of this invention is to supply an electrical heating device that facilitates its conformation to the surface on which it is required to operate.

The foregoing and other aspects of the invention are provided by a de-icer device comprising:

a tread mat;

metal heat conducting members;

hollow metal tubing; and electrical heating wire, wherein said mat has a plurality of vertical passageway passing therethrough for draining water from the upper surface of the mat to its lower surface, said mat being adapted to receive said tubing that traverses therethrough, and said heat conducting members being adapted to transfer heat form said tubing to the exterior of the mat and being located between such surfaces, and wherein said heat conducting members are in contact with said tubing, and wherein further, said tubing has electrical heating wire for generating heat upon energization located on the interior thereof.

The foregoing and additional aspects of the invention are provided by an electrical de-icer device comprising:

elongated link elements;

metal heat conducting members;

hollow metal tubing; and electrical heating wire, said link elements being disposed parallel to each other in adjacent parallel rows, the ends of said elements in one row being interleaved with the ends of said elements in adjacent rows to form files of interleaved ends, said interleaved ends being connected together by said tubing passing through the interleaved ends at substantially right angles thereto, wherein said members are positioned between said interleaved ends, said tubing also passing through said members and in contact therewith by means of holes therein, the top of said members extending vertically from said tubing to a point no higher than about the upper surface of said device, and wherein said tubing forms a continuous tubular pathway through said device, said tubing having said electrical heating wire located in the interior thereof.

The foregoing and additional aspects of the invention are provided by an electrical de-icer device comprising:
a tread mat;
metal heat conducting members;
hollow metal tubing; and
electrical heating wire, said tread mat comprising a unitary mat having a pattern of vertical passageways therein extending from the upper surface to the lower surface of said mat, said mat being provided with horizontal passageways between said surfaces adapted to recieve said tubing therein, and said mat also being provided with vertical slots extending from one of said surfaces, at substantially right angles to said horizontal passageways, adapted to receive said members, and wherein said slots and said horizontal pasageways are in a relationship such that the tubing passing through said horizontal passageways also passes through said members by means of holes therein, and in contact with said members, the top of said members extending vertically from said tubing to a point no higher than about the upper surface of said mat, and wherein further, said tubing forms a continuous tubular pathway through said device, said tubing having said electrical heating wire located in the interior thereof.

BRIEF DESCRIPTION OF THE DRAWINGS

The invention will be better understood when reference is had to the following drawings in which like-numbers refer to like-parts and in which.

DETAILED DESCRIPTION OF THE INVENTION

Figure 1:
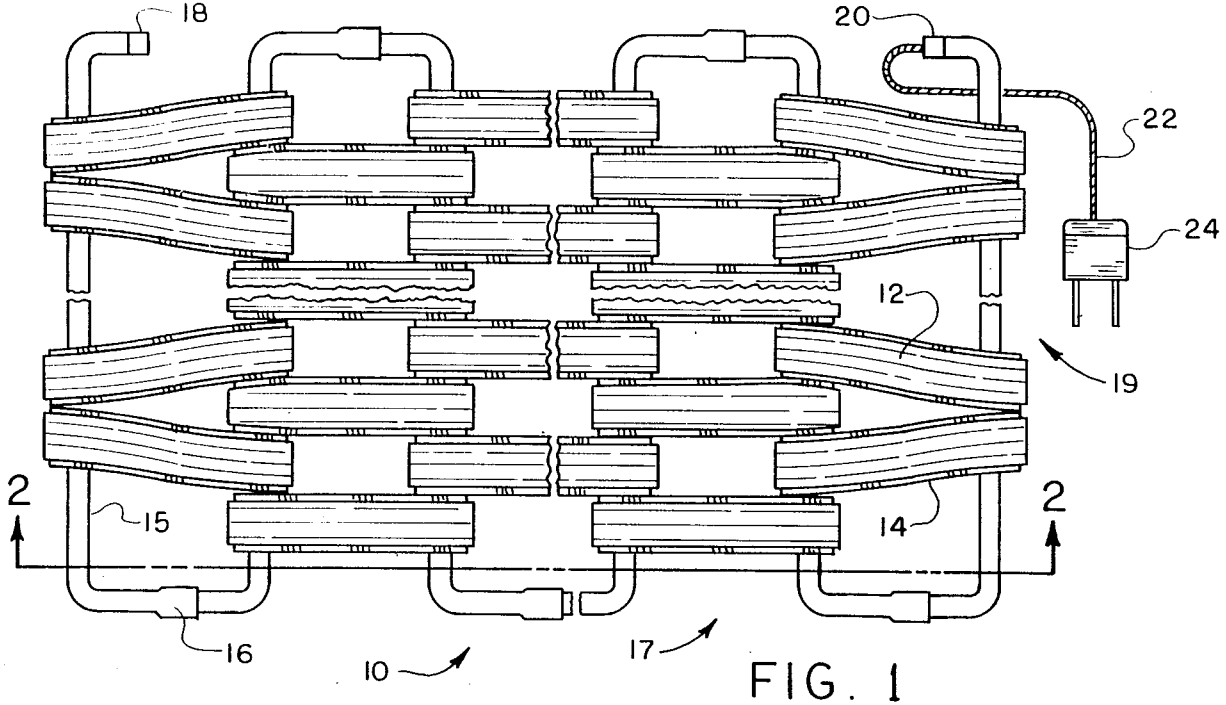
FIG. 1 is a plan view of the de-icer device of the invention.

FIG. 1 is a plan view of the de-icer device of the invention, generally 10. The Figure comprises a number of rows of link elements 12, the ends of which are interleaved with each other to form files through which lengths of hollow metal tubing 15 are inserted through holes in the elements. Associated with the link elements, and substantially coextensive therewith, are metal heat conducting member 14. The lengths of metal tubing 15 also pass through holes disposed in the ends of the members, in contact therewith, producing a structure resembling a tread mat having a pattern of vertical passageways therein, the passageways being formed by the spaces between the link elements and associated heat conducting members.

The ends of the lengths of metal tubing 15 are connected at their ends to the ends of adjacent lengths of tubing, in the Figure by connecting means comprising male/female joints 16. The connection of the lengths of tubing in the manner described serves to form a continuous tubular pathway through which electrical heating wire 22 is inserted. The electrical heating wire is sealed within the tubing by means of tubing seals 18 and 20, respectively, and is activated by connection of the wiring to an electrical outlet, for example, by means of an electrical plug 24.

The electrical de-icer device is used by placing the device wherever it is required, for example, on ramps, sidewalks, entranceways, etc., preferably before the snow which it is designed to protect against has fallen. Following its placement, the electrical wire is connected to a source of electrical energy, although such connection may be deferred until the arrival of inclement weather. While the orientation of the mat on the surface which it protects is relatively unimportant, it will frequently be placed so that the link elements 12 run transversely, relative to the anticipated traffic, so that the pattern of vertical passageways presents minimal interference to traffic over the device, for example, to the wheels of wheelchairs.

The dimensions of the mat may be varied as required to provide compatibility with the conditions of use; however, mats having overall dimensions of about three feet by three feet are readily portable, and have proven useful in a variety of locations in which they are used. The interconnection of mats of such size is possible to protect larger areas, as will be explained in more detail in connection with FIG. 7.

The components of the mat described in FIG. 1, may also vary considerably. For example, the link elements may conveniently be from about one-eighth to one-half inch wide, and from approximately one and one-half to four and one-half inches long. The vertical height of the elements typically will be from about one-half to one inch high. In one embodiment of the invention, the link elements are cut from discarded automobile tires, providing a non-slip surface, as well as being low cost, and helping to solve the problem of the disposal of such tires.

The heat conducting elements may likewise may very in size, for instance, they are frequently from about one-sixteenth to one-eighth inch thick. As previously indicated, they will generally be coextensive in length and height with the link elements, by normally will not extend higher than the upper surface of such elements, preferably from about one-sixteenth to one-eighth inch lower, so that the link elements, with their better frictional characteristics can remain in contact with traffic over the mat, thus providing better anti-slip characteristics.

Figure 2:
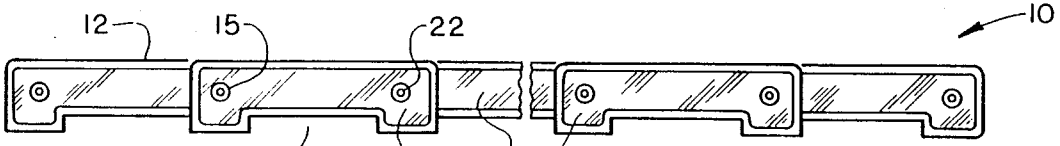
FIG. 2 is a side elevation of the de-icer device shown in FIG. 1 along line 2—2 of FIG. 1.

FIG. 2 is a side elevation of the de-icer device shown in FIG. 1 along line 2—2 of FIG. 1, generally 10. The Figure provides more detail concerning one alternative shape of the link elements 12, and of the associated metal heat conductors 14, such components being connected in an interleaved arrangement by means of lengths of metal tubing 15, containing the electrical heating wire 22.

While the use of discarded automobile tires furnishes a low-cost source of material from which the link elements may be made, plastic materials such as polyvinyl chloride, various polyolefins, neoprene, EPDM, and various other plastic or elastomeric materials may also be employed. The use of materials that can be molded to provide components with holes to accommodate insertion of the tubing 15 is preferred for a variety of reasons, including the fact that dimensionally more compact link elements may be formed without compromising the strength of the elements by the need to drill holes through them.

The metal heat conducting members and the tubing can likewise be formed from a variety of metals, such as aluminum, copper, steel, including stainless metal, brass and the like. The use of galvanized aluminum tubing constitutes a preferred embodiment of the invention, however, since such material is inexpensive, lightweight, and corrosion resistant.

The diameter of the tubing will depend upon the dimensions of the other components making up the de-icer, however, tubing having a diameter of from about one quarter inch to three-eighths inch has been found to be particularly suitable, especially in connection with devices formed from components having the dimensions described.

Figure 3:
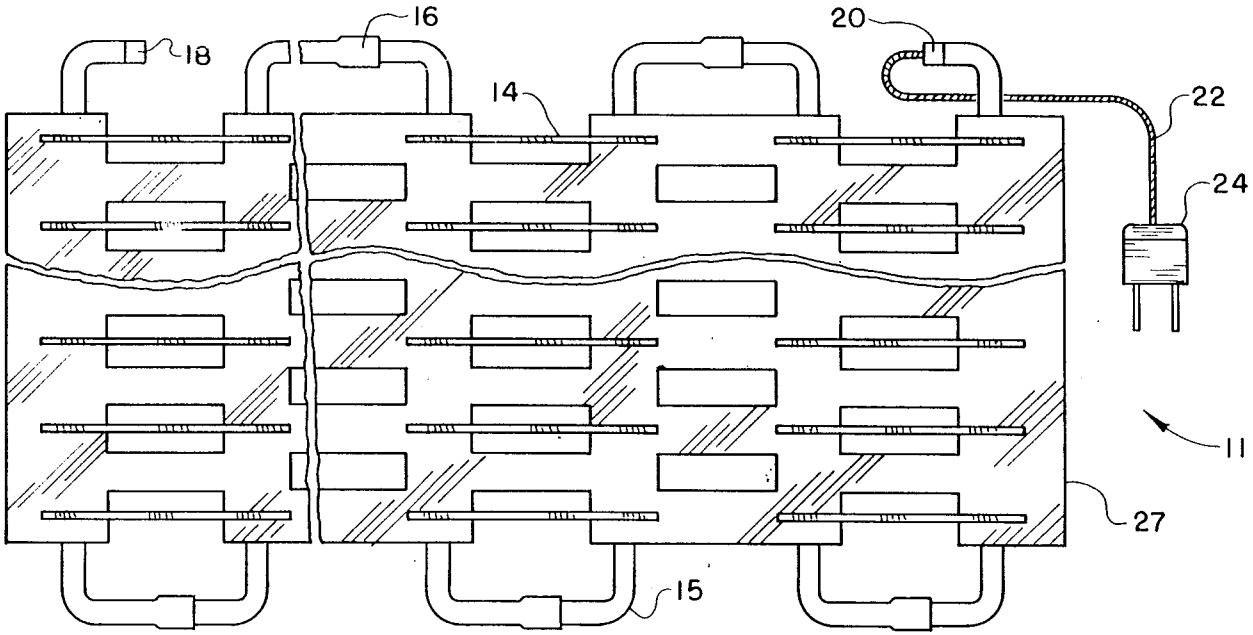
FIG. 3 is a plan view of another embodiment of the de-icer device of the invention.

FIG. 3 is a plan view of another embodiment of the de-icer device of the invention, generally 11. The device in the Figure comprehends a molded mat 27 provided with a pattern of vertical passageways extending from the upper surface of the mat to its lower surface, and in which vertical slots are provided into which metal heat conducting members 14 are inserted. The heat conducting members 14 are held within the mat by means of lengths of hollow metal tubing 15 extending through transverse horizontal passageways molded in the mat, the lengths of tubing also passing through holes located in the ends of the conducting members. The lengths of tubing 15 are connected exterior of the mat ends by means of male/female connections 16 to form a continuous tubular pathway through the device. Tubing seals 18 and 20 are provided at the ends of the tubing, effectively sealing an electrical heating wire 22 therein. The heating wire can be connected to a power outlet by means of an electrical plug 24. If desired during the summertime, the plug-terminated section of wire extending from the tubing may be removed, for example by being detached at a suitable connection located at the end of the tubing, so as to provide an unheated mat.

Any of the high resistance heating wires of the types well known in the art are suitable for purposes of the invention. The resistence of the wire will depend upon characteristics of the electrical service to which the devices are to be connected, that is, the electrical load that can be accommodated, and will be affected the number of devices which are to be connected together, as discussed more particularly in connection with FIG. 7, as well as similar considerations. In most instances, the use of heating wire capable of producing about three watts per foot is well suited for use with the invention, and wiring in which a third, or ground wire, is connected to the tubing 15 is preferred since it provides additional safety and protection from inadvertent electrical shorting.

Figure 4:
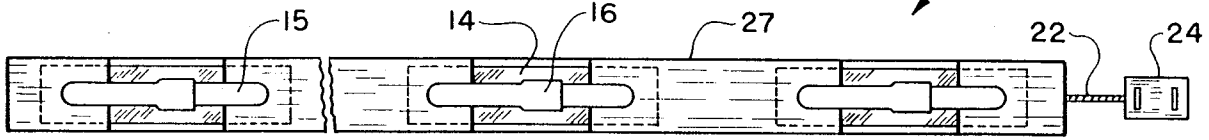
FIG. 4 is a side elevation of the de-icer device shown in FIG. 3.

FIG. 4 is a side elevation of the de-icer device shown in FIG. 3, generally 11, illustrating details of the molded mat 27, and showing how the metal conducting members 14 are located in the mat slots. The Figure shows the electrical heating wire 22, connected to an electrical plug 24, sealed in tubing 15 by means tubing seals 18 and 20.

While male/female joints 16, which can be soldered, brazed, or welded together, are employed for the tubing connections shown in the Figure, it is sometimes desirable to provide flexible connections between the lengths of tubing 15 so that the mat can be rolled up for storage, or bent to conform to irregular surfaces or which it is placed. Methods of providing a flexible connection include structures such as short lengths of heavy-duty plastic tubing, corrugated metal tubing, mechanical seal asemblies, and various other well known flexible connections.

Figure 5:
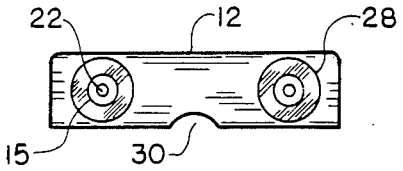
FIG. 5 is a side elevation of another embodiment of a link element and heat conductor of the invention.

FIG. 5 is a side elevation of another embodiment of a link element of the invention and associated heat conductors. As shown, a link element 12 is provided with a melt channel 30 disposed in the bottom thereof. The melt channel indicated is somewhat different from the melt channel 26 shown in FIG. 2, the channels furnishing a passageway through which the water from the snow and ice melt can escape the device. FIG. 5 also shows metal heat conducting members 28 in the form of washer-shaped members, as opposed to the elongated conducting members illustrated in FIGS. 1 and 3, respectively. Metal tubing 15, with electrical heating wire 22 on the interior thereof, passes through the members.

Irrespective of their shape, the heat conducting members greatly enhance the ability of the de-icer device to melt snow and ice in contact therewith. While the electrical heating wire 15 serves to heat the metal tubing 25 above the melting point of ice and snow, when the tubing passes through the heat conducting members of the invention, the latter are likewise warmed and the heat generated in the tubing passes along the conducting member to areas spaced from the tubing, thus allowing the heat to be uniformly distributed across the surface of the device, producing a more uniform and rapid melting action than would otherwise be possible. Although a variety of different shaped conducting devices can be employed, as indicated, the use of elongated conducting members provided with a hole on either end for penetration by the heated tubing is preferred, since it permits conduction of the heat generated over a wider area. Irrespective of the shape of the heat conducting member, however, it is necessary that it be in contact with the exterior surface of the tubing so that maximum heat transfer can be achieved between the tubing and the member. Again, and as in the case of the conductors discussed in connection with the previous Figures, it is desirable that the washer-shaped conductors illustrated in FIG. 5 be of a size such that their upper surface does not extend beyond the upper surface of the mat, preferably somewhat below it, to provide for wearing of the link element's surface.

Figure 6:
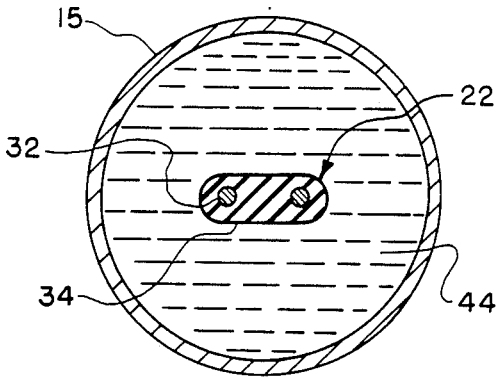
FIG. 6 is a cross-section of the tubing used in connection with the invention.

FIG. 6 is a cross-section of the tubing used in connection with the invention. As shown, the heating wire 34, including electrical conductors 32 disposed within the interior of insulation 34, is located within the tubing 15. In order to improve heat transfer between the wire 22 and the tubing 15, it is sometimes desirable to include a liquid heat transfer medium 44 on the interior of the tubing. The heat transfer medium may be comprised of a liquid in the form of a paste, an oil, a gel, or a relatively free-flowing liquid, materials such as ethylene glycol, oils, and similar materials, preferably having an relatively high dielectric constant, low vapor pressures, and of a non-corrosive nature being useful for the purpose.

Figure 7:
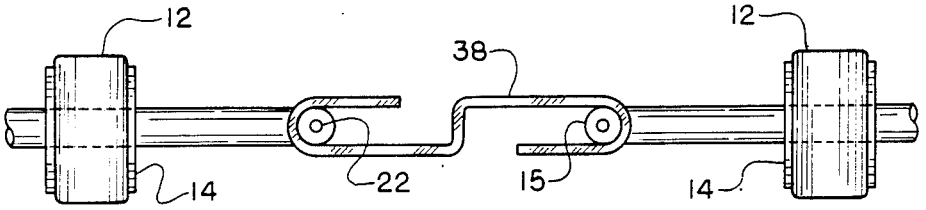
FIG. 7 is a partial view of two of the de-icer devices of the invention connected by fastener means.

FIG. 7 is a partial view of two of the de-icer devices of the invention connected by fastener means. The Figure indicates how a generally S-shaped fastener 38 can be placed over the tubing 15 extending from the peripheral portions of the de-icer mat, connecting adjacent mats together. FIG. 7 illustrates connection of side 17 of the mat, as shown in FIG. 1, with a similar side of an adjacent mat. The Figure also shows further details of the relationship between the tubing 15 with the heat conducting members 14 and the link elements 12, end views of the latter two being illustrated.

Connection of the mats with the fasteners in desirable when larger areas are to be connected. In such cases, the electrical heating wire 22 does not form a closed loop, or circuit, within an individual mat, but is designed to be electrically connected in series with an adjacent mat, for example at the ends of the wire adjacent to tubing seals 18 and 20. When the individual mats making up such a connected series are to be used individually, a conductor-connecting element is inserted into one end of the tubing, for example, adjacent to 18, to complete the electrical circuit, while a length of connecting wire with a plug 24 on the end thereof is connected to the wiring at the opposite end of the tubing. Whatever number of mats is required to cover the surface of the area to be protected may thus be mechanically and electrically fastened together, the limiting factor being the electrical characteristics of the power source to which the mats are to be connected, the resistance value of the wire, and similar factors, as previously explained.

Figure 8:
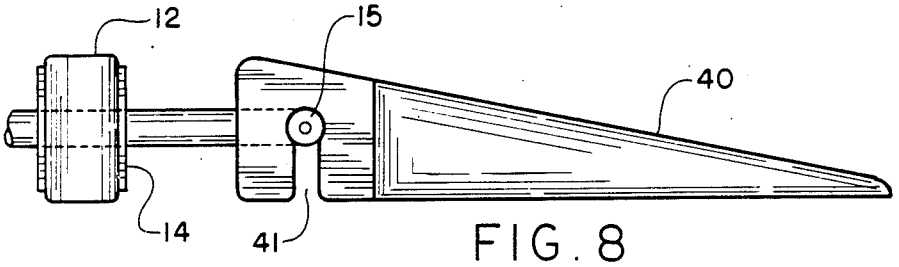
FIG. 8 is a side elevation of an inclined ramp attached to a de-icer device of the invention.

FIG. 8 is a side elevation of an inclined ramp attached to a de-icer device of the invention. As illustrated, an inclined ramp 40 with a slot 41 is placed over tubing 15 on side 17 of the mat 10 shown in FIG. 1. When connected, the inclined ramp 40 is disposed adjacent to the outermost link elements 12 with their associated conducting members 14. While not essential, the ramps are a preferred embodiment of the invention since they provide a transition surface between the top surface of the mat and the surface upon which the mat rests, reducing the risk of individuals tripping over the edges of the mats. The ramps described can be located on one or more sides of the mat, fastened to exposed tubing, either on sides 17 or 19 of the mats as shown in FIG. 1, depending upon the direction from which traffic is anticipated.

An alternative disposition of the mats sometimes useful, is to provide recessed slots in the surface to be protected into which the mat components, for example, the link elements and their associated conducting members can be inserted, thereby providing a flush installation and minimizing the risk of tripping. In such instances, it is often desirable to insert the vertical flange of a T-shaped profile between the edge of the mat, and the outer perimeter of the recessed area, thus protecting the edges of the recessed area from chipping, as in the case of concrete surfaces. Desirably, the horizontal surface of the T-shaped member is long enough to extend over and protect projecting tubing, for instance, that extending from side 17 of the mat in FIG. 1.

Figure 9:
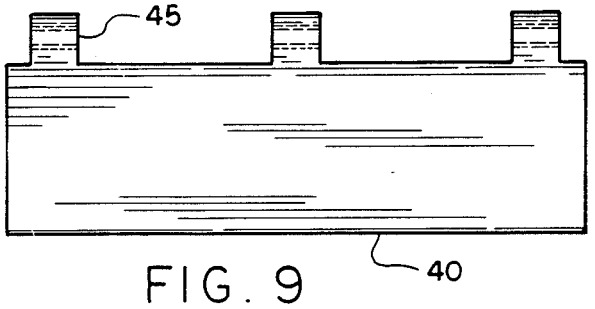
FIG. 9 is a top plan view of the inclined ramp of FIG. 8.

FIG. 9 is a top plan view of the inclined ramp of FIG. 8. The ramp 40 is shown with three tubing connecting tabs 45; however, more or less than that number may be used. In addition, the ramp structure illustrated is merely one of a number of ramp designs that could be used in conjunction with the electrical de-icer ramp devices comtemplated by the invention.

The de-icer device disclosed may also be provided with thermostatic means adapted to control the flow of current, and therefore, the heat output of electric heating wire 22. The use of a temperature detection device in conjunction with a moisture detector, of the type well known in the art, provides a convenient way in which to automatically activate the de-icer device. For example, when the presence of moisture is detected simultaneously with ambient temperatures low enough to produce icing conditions, the device can be programmed to activate, preventing formation of ice or snow accumulations on the mat. The use of such devices in conjunction with a microprocessor is particularly suitable for programing the de-icer device to activate upon detection of predetermined weather conditions. The device may also conveniently be employed in conjunction with a rheostat for controlling the magnitude of the current flow to the device.

While in accordance with the present statutes, a preferred embodiment and best mode has been described, the scope of the invention is not limited thereto, but rather is measured by the scope of the attached claims.

What is claimed is:

1. A de-icer device comprising:

a tread mat;

metal heat conducting members;

hollow metal tubing traversing the mat; and electrical heating wire, wherein said mat has a plurality of passageways passing therethrough for draining water from the upper surface of the mat to its lower surface, and said heat conducting members being adapted to transfer heat from said tubing to the exterior of the mat and being located between said surfaces, the top of said members being below, but substantially adjacent to said upper surface, and wherein said heat conducting members are in contact with said tubing, and wherein further, said electrical heating wire is located on the inside of said tubing for generating heat upon energization of the wire to heat the tubing and the heat conducting members.

2. A de-icer device according to claim 1 wherein the top of said members is located between the top of said tubing and the upper surface of said mat.

3. An electrical de-icer device according to claim 1 wherein in addition to said heating wire, said tubing has a liquid heat transfer medium located therein.

4. An electrical de-icer device comprising:

elongated link elements;

metal heat conducting members;

hollow metal tubing; and electrical heating wire, said link elements being disposed parallel to each other in adjacent parallel rows, ends of said elements in one row being interleaved with the ends of said elements in adjacent rows to form files of interleaved ends, said interleaved ends being connected together by said tubing passing through the interleaved ends at substantially right angles thereto, wherein said members are positioned between said interleaved ends, said tubing also passing through said members and in contact therewith by means of holes therein, the top of said members extending vertically from said tubing to a point below, but substantially adjacent to the upper surface of said device, and wherein said tubing forms a continuous tubular pathway through said device, said tubing having said electrical heating wire located in the interior thereof.

5. An electrical de-icer device according to claim 4 wherein said members extend substantially coextensively with, and parallel to said link elements, and wherein each end of said members has a length of tubing passing through a hole therein.

6. An electrical de-icer device according to claim 4 wherein said link elements are formed from a member of the group consisting of elastomeric materials and plastic materials.

7. An electrical de-icer device according to claim 4 wherein in addition to said heating wire, said tubing has a liquid heat transfer medium located therein.

8. An electrical de-icer device according to claim 4 wherein each of said link elements is provided with at least one groove extending across the lower surface thereof, permitting the flow of melt water therethrough.

9. An electrical de-icer device according to claim 4 wherein said elements and said heat conducting members are configured to form a grid, and wherein said tubing is formed from lengths of hollow metal tubing, one of which lengths passes through each file of interleaved ends, the ends of said lengths being connected tubular by connecting means to the ends of adjacent lengths to form said continuous tubular pathway.

10. An electrical de-icer device according to claim 9 wherein said connection means is flexible.

11. An electrical heating device in which a plurality of the grids according to claim 7 are interconnected by fastener means to form an assembly of said grids.

12. An electrical de-icer device according to claim 9 wherein at least one edge of the grid has an inclined ramp attached thereto, providing a transition surface from the upper surface of said grid to the surface on which said grid rests.

13. An electrical de-icer device comprising:

a tread mat;

metal heat conducting members;

hollow metal tubing; and electrical heating wire, said tread mat comprising a unitary mat having a pattern of passageways for water therein extending from the upper surface to the lower surface of said mat, said mat being provided with horizontal passagaway between said surfaces adapted to receive said tubing therein, and said mat also being provided with vertical slots extending from one of said surfaces, at substantially right angles to said horizontal passageways, adapted to receive said members, and wherein said slots and said horizontal passageways are in a relationship such that the tubing passing through said horizontal passageways also passes through said members by means of holes therein, and in contact with said members, to top said members extending vertically from said tubing to a point no higher than about the upper surface of said mat, and wherein further, said tubing forms a continous tubular pathway through said device, said tubing having said electrical heating wire located on the interior thereof.

14. An electrical de-icer device according to claim 13 wherein said members are elongate members with a hole in a each end, said members being positioned parallel to each other in rows, said rows being parallel to each other.

15. A electrical de-icer device according to claim 14 wherein said tubing is formed from lengths of hollow metal tubing, one of said lengths passing through each end of said members, in each of said rows, the ends of said lengths being connected by connecting means to the ends of adjacent lengths to form said continuous tubular pathway.

16. An electrical device according to claim 13 wherein said tread mat is molded from a member of group consisting of elastomeric materials and plastic materials.

17. An electrical de-icer device according to claim 13 wherein in addition to said heating wire, said tubing has a liquid heat transfer medium located therein.

18. A de-icer matting device comprising:

a tread mat having upper and lower surfaces;

a plurality of wire-holding tubular means traversing that mat between the upper and lower surfaces;

a plurality of metal heat conducting members extending from said tubular means between said upper and lower surfaces; and electrical heating wires extending through said tubular means, wherein heat can be conducted from said wires to said tubular and to said conducting members to de-ice said mat.

19. A de-icer apparatus according to claim 18 wherein said mat has rows parallel link elements, each row being offset from adjacent rows so that the ends of the links in adjacent rows overlap, the overlapped ends forming columns, and said tubular means comprising parallel rows of tubes extending through the columns' overlapped link 20. A de-icer apparatus according to claim 19 wherein said heat conducting members have approximately the same length as said links, and are matched to said links and mounted on the same tubes as the matched links.

* * * * *